United States Patent [19]

Bartlett

[11] 4,106,437

[45] Aug. 15, 1978

[54] APPARATUS FOR MULTIPLE STRIPE COATING

[75] Inventor: Lawrence C. Bartlett, Rochester, N.Y.

[73] Assignee: Eastman Kodak Company, Rochester, N.Y.

[21] Appl. No.: 826,616

[22] Filed: Aug. 22, 1977

[51] Int. Cl.[2] ..... B05C 5/02

[52] U.S. Cl. ..... 118/412

[58] Field of Search ..... 118/411, 412, 410, 415; 427/286

[56] References Cited

U.S. PATENT DOCUMENTS

| | | | |
|---|---|---|---|
| 2,770,217 | 11/1956 | Kasak | 118/410 |
| 3,627,564 | 12/1971 | Mercier | 118/412 X |
| 3,973,961 | 8/1976 | Ströszynski | 118/410 X |

*Primary Examiner*—John P. McIntosh
*Attorney, Agent, or Firm*—A. P. Lorenzo

[57] ABSTRACT

An apparatus for multiple stripe coating of a web with liquid coating composition is comprised of a hopper having a pair of spaced lips and a pair of shims mounted in face-to-face arrangement within the hopper and positioned between the spaced lips. One of the shims is provided with a plurality of open-ended channels while the second shim is equipped with a plurality of projecting portions, corresponding in width and location to the desired stripes, which are in alignment with the open-ended channels and project beyond the open ends thereof. The apparatus is capable of carrying out multiple stripe coating of a web at high speeds and with a high degree of precision in regard to stripe width and registration.

8 Claims, 5 Drawing Figures

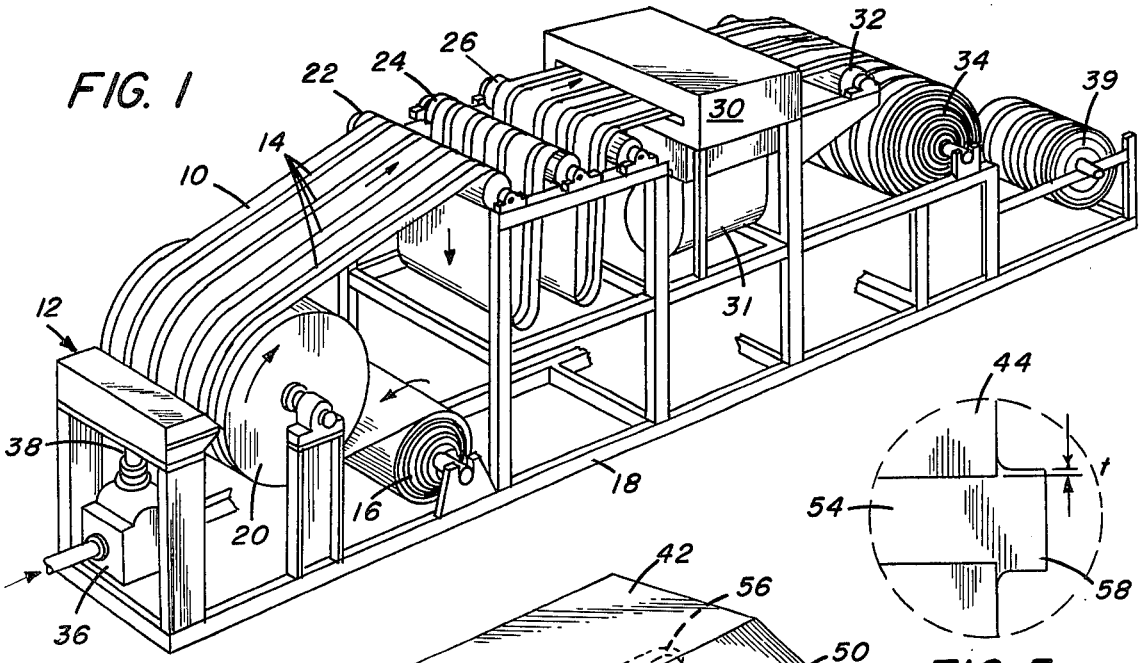
FIG. 1
FIG. 5
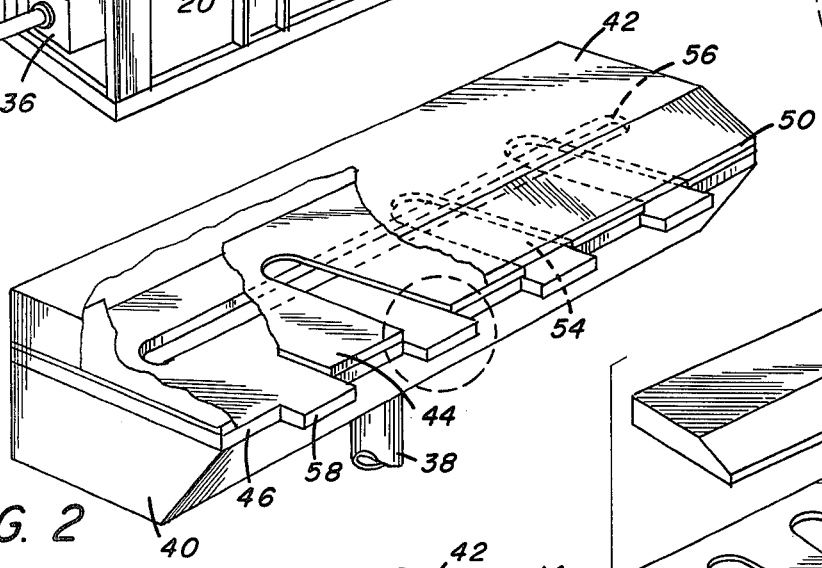
FIG. 2
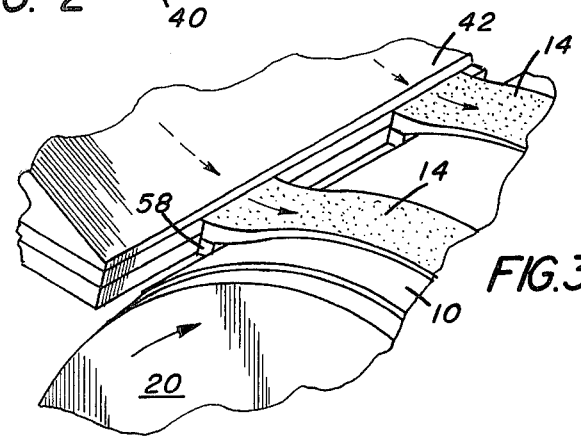
FIG. 4
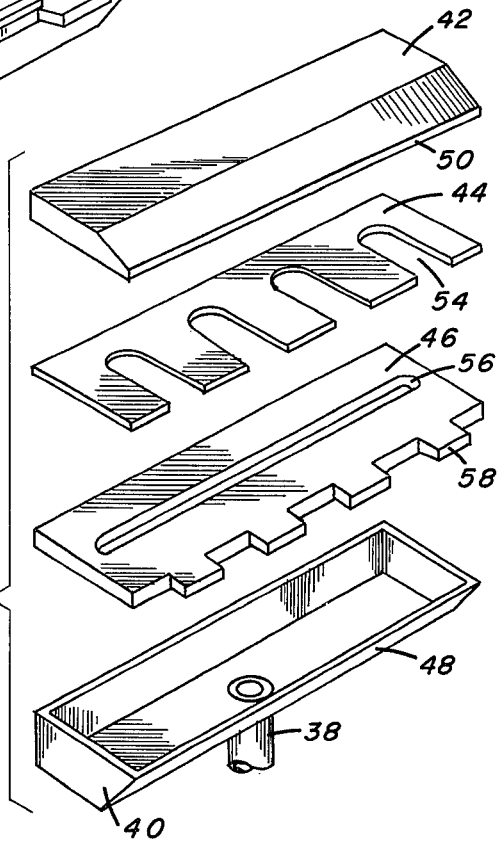
FIG. 3

APPARATUS FOR MULTIPLE STRIPE COATING

BACKGROUND OF THE INVENTION

1. Field of the Invention

This invention relates in general to coating apparatus and in particular to apparatus for coating a web with a liquid coating composition. More specifically, this invention relates to a novel apparatus for multiple stripe coating of a web.

2. Description of the Prior Art

A variety of techniques are known for multiple stripe coating of a web, that is, for applying a coating composition to a web in the form of a plurality of stripes each of which is separated from an adjacent stripe by a region which is uncoated. Such coatings can be applied, for example, by the use of a coating roll provided with a plurality of grooves corresponding to the stripes to be applied. Another form of apparatus for use in multiple stripe coating is described in British Pat. No. 384,293. This patent describes an apparatus comprising a coating trough provided with openings adjacent to the apex of the trough, means for mounting the trough with the apex contacting the web to be coated, and means for tilting the trough to vary the extent to which the web partially covers the openings and thereby vary the amount of coating composition applied. An alternative type of multiple stripe coating apparatus is that of Canadian Pat. No. 770,540 which describes an apparatus comprising an applicator head having a plurality of bores formed therein and a web-engaging surface in the form of spaced lands which separate the bores from one another. Other types of striping apparatus are disclosed in U.S. Pat. No. 3,032,008 which describes a device comprising a multiplicity of aligned nozzles defining at least two different sets with the nozzles in each set being connected to a supply of coating composition under pressure; in Russian Pat. No. 413,053 which describes a slide hopper adapted for stripe coating by the provision of shims or inserts within the slots and guide rails which fit tightly against the slide surfaces; and in U.S. Pat. No. 3,886,898 which describes an apparatus comprised of block-like members equipped with a plurality of orifices and separated by thin flat dividers. While these devices are all capable of applying a plurality of stripes to a web, difficulties are frequently encountered in achieving precise control of stripe width and registration and the apparatus is often unduly complex and difficult to maintain. It is toward the objective of avoiding such difficulties and providing a simple and effective multiple stripe coating apparatus that is capable of providing a high degree of accuracy in stripe width and registration that the present invention is directed.

SUMMARY OF THE INVENTION

In accordance with the present invention, there is provided a coating apparatus for multiple stripe coating of a web with liquid coating composition that is capable of carrying out the coating operation at high speeds and with a high degree of precision in regard to stripe width and registration. The apparatus comprises an extrusion hopper and means for advancing the web across and closely adjacent to the lips of the extrusion hopper where it receives the coating composition in the form of a plurality of spaced parallel stripes. Appropriate conveying and drying equipment is utilized in conjunction with the extrusion hopper to advance the web at the desired speed and to dry the liquid coating composition deposited on the web by the hopper. The extrusion hopper is equipped with a pair of shims which serve to channel the flow of coating composition so that it exits from the hopper as a plurality of separately flowing streams each of which forms a stripe on the web. More specifically, the extrusion hopper includes a pair of spaced lips and the shims are mounted in face-to-face arrangement within the hopper and positioned between the spaced lips. One of the shims is provided with a plurality of open-ended channels while the second shim is equipped with a plurality of projecting portions, corresponding in width and location to the desired stripes, which are in alignment with the open-ended channels and project beyond the open ends thereof. Coating composition flowing into the hopper is directed by the open-ended channels onto the projecting portions and flows from these projecting portions onto the closely adjacent moving web to form stripes of uniform width located in exactly the desired position on the web. The combined action of each open-ended channel, functioning in concert with its associated projecting portion, serves to effectively guide the coating composition in the desired flow path with a degree of precision that avoids problems encountered in the prior art in achieving the desired accuracy in stripe width and registration.

BRIEF DESCRIPTION OF THE DRAWINGS

In the Drawings:

FIG. 1 is a perspective view of a coating apparatus and associated conveying and drying apparatus constructed in accordance with this invention.

FIG. 2 is a perspective view of the coating apparatus partially broken away to expose the interior thereof.

FIG. 3 is an exploded perspective of the coating apparatus.

FIG. 4 is a perspective view of a portion of the coating apparatus and adjacent web-supporting drum illustrating the application of stripes of coating composition to a moving web.

FIG. 5 is a detail view of that portion of the coating apparatus within the circle shown in broken lines in FIG. 2.

DESCRIPTION OF THE PREFERRED EMBODIMENTS

Referring to FIG. 1, there is shown an apparatus adapted to convey a web 10 across and in close proximity to a coating device, indicated generally by the numeral 12, which applies to the surface of web 10 a plurality of stripes 14 formed from a liquid coating composition. Web 10 is withdrawn from supply roll 16, which is rotatably mounted on frame 18, and passes over drum 20 and then, in succession, over idling rollers 22, 24 and 26, through drying chamber 30, over idling roller 32 and onto take-up roll 34. Drum 20 serves to guide and support moving web 10 and maintain it at exactly the desired position with respect to coating device 12. Pump 36 supplies liquid coating composition under pressure from a supply source (not shown) to coating device 12 via inlet tube 38. Warm air or other gaseous medium is supplied to drying chamber 30 by blower 31 under appropriate conditions of temperature, humidity and flow rate to dry the coating. The coating operation is carried out in a semi-continuous manner, with operation being interrupted to permit withdrawal of a roll of coated web, or in a continuous manner with take-up rolls being replaced "on-the-fly", i.e., without interruption of the coating process. A second roll 39 of stripe-coated web is shown at the end of frame 18 awaiting removal for storage or use.

As shown in FIGS. 2 and 3, coating device 12 is comprised of a trough 40, having inlet tube 38 attached thereto, a shim 44, a second shim 46, and a cover plate 42 which is of corresponding dimensions to trough 40 and adapted to form therewith a coating hopper. Trough 40 and cover plate 42 are provided with lip portions 48 and 50, respectively, which engage shims 46 and 44, respectively, when all parts are assembled together by suitable fastening means (not shown) such as bolts or clamps. Shim 44 is provided with a series of open-ended channels 54. Shim 46 is provided with an elongated slot 56 extending over substantially its full width and with a series of projecting portions 58. In assembled form, shim 44 and shim 46 are positioned in face-to-face arrangement and are mounted within the hopper formed by trough 40 and cover plate 42 so that the open ends of channels 54 define a plurality of extrusion slots. Projecting portions 58, corresponding in width and location to the stripes 14 which are applied to web 10, are aligned with channels 54 and extend beyond the open ends thereof.

In the embodiment shown in the drawings, trough 40 is provided with front, back and side walls adapted for sealing engagement with shim 46 and cover plate 42 is adapted for sealing engagement with shim 44. In an alternative embodiment, (not shown) trough 40 is constructed with walls that are provided with a recessed ledge to receive shims 44 and 46 and cover plate 42 is adapted to engage trough 40 to provide a liquid-tight seal along the back and side walls thereof. Similarly, in the embodiment shown in the drawings, open-ended channels 54 take the form of cut-out portions in shim 44 but instead they could take the form of grooves having a depth that is only a portion of the thickness of shim 44. Such grooves could be formed by milling procedures well known in the machining art. As long as they are of the appropriate width and depth and are properly positioned, such milled grooves on the bottom side of shim 44 would serve equally as well as channels which have been cut from the shim. Elongated slot 56 which serves to supply coating composition to open-ended channels 54 could also take other suitable forms such as, for example, a series of small holes extending across substantially the same width as slot 56.

In operation of the coating apparatus, liquid coating composition passes into trough 40 via inlet tube 38 and then flows through slot 56 and along channels 54 onto projecting portions 58 from which it is coated onto web 10 in the form of a plurality of parallel stripes 14, as shown in FIG. 4. Shim 44 serves to channel the flow of coating composition to the lips of the hopper. Shim 46 serves to stabilize each channel of liquid flow from shim 44, so that the coating apparatus coats the stripes in perfect registration, and also aids in achieving uniformity in stripe width. Advantageously, the width of projecting portions 58 is just slightly greater than the width of channels 54 to aid in ensuring that all coating composition flowing in the path formed by one of channels 54 is properly directed by the associated projecting portion 58 to form the desired stripe registration and edge contour. This is shown in FIG. 5 which indicates that there is a slight difference in the widths of projecting portion 58 and channel 54. The extent to which projecting portion 58 extends laterally beyond channel 54 is designated by the symbol "*t*". As also shown in FIG. 5, projecting portion 58 is flared outwardly towards the end which is closest to channel 54 so as to facilitate the smooth and uninterrupted flow of coating composition from channel 54 onto projecting portion 58. In a preferred embodiment, projecting portions 58 gradually taper down in thickness so that they terminate in a sharp edge which facilitates smooth transfer of the coating composition to the web. It is also preferred that the projecting portions 58 have sharp corners to guide the flow of coating composition along a clearly defined path.

The multiple stripe coating apparatus of this invention is useful to coat many different kinds of web materials with many different kinds of liquid coating compositions. For example, the web could be composed of paper, polymer-coated paper such as polyethylene-coated paper, fabric, metal foil, or plastic film such as cellulose nitrate film, cellulose acetate film, polyvinyl acetal film, polyethylene film, polypropylene film, polycarbonate film, polystyrene film or polyester film. The coating composition could be a solution or dispersion of polymeric material containing a dye or pigment, a magnetic dispersion, a phosphor dispersion, a radiation-sensitive photographic emulsion, or an adhesive composition. Web materials which can be successfully stripe-coated with the apparatus described herein can be of any suitable width, for example a width ranging from a few inches to several feet. The stripes can also vary in width as desired, a typical range being from about one sixteenth of an inch to about 3 inches, and can be spaced by any desired distance from adjacent stripes. The apparatus can be used to apply stripes of different width and/or different spacing across the width-wise extent of the web, as desired.

The dimensional characteristics of the apparatus can be varied widely to meet the objectives of a particular end use. As a typical example, the shim having the open-ended channels therein can have a thickness in the range from about 0.002 to about 0.02 inches, the shim having the projecting portions can have a thickness in the range from about 0.001 to about 0.05 inches, and the projecting portions can project beyond the open ends of the channels by a distance in the range from about 0.002 to about 0.03 inches. Projecting portions which extend about 0.01 inches have been found to be particularly effective under a variety of coating conditions. The optimum spacing of the coating hopper from the surface of the web will depend on the speed of coating and the characteristics of the coating composition, a typical spacing being about 0.01 inches. As previously indicated herein, the width of a projecting portion is advantageously slightly greater than the width of its associated open-ended channel. Thus, a typical value for "*t*" in *FIG. 5* is about 0.01 inches.

The coating apparatus described herein is inexpensive, simple in construction, and very easy to dismantle for cleaning or maintenance and then reassemble. It can be operated with good results at low coating speeds, such as speeds of 10 to 50 feet per minute, at high coating speeds, such as speeds of 100 to 500 feet per minute and higher, and at intermediate speeds. Vacuum is advantageously utilized to stabilize the coating operation at high speeds, as is well known in the coating art. For example, 1 to 3 inches of water vacuum is beneficial for coating at speeds of 100 to 300 feet per minute. Stripe width and registration can be reproduced with an accuracy within a few thousandths of an inch by means of the apparatus of the present invention.

The invention has been described in detail with particular reference to preferred embodiments thereof, but it will be understood that variations and modifications can be effected within the spirit and scope of the invention.

What is claimed is:

1. Apparatus for multiple stripe coating of a web with liquid coating composition, said apparatus comprising:
   (1) a hopper communicating with a supply of said liquid coating composition, said hopper including a pair of spaced lips;
   (2) a first shim mounted within said hopper and positioned between said spaced lips, said first shim having a plurality of open-ended channels therein;
   (3) a second shim mounted within said hopper and positioned between said spaced lips in face-to-face arrangement with said first shim, said second shim having a plurality of projecting portions corresponding in width and location to the desired stripes, said projecting portions aligning with said open-ended channels and extending beyond the open ends thereof; and
   (4) means for advancing the web to be coated across and closely adjacent to said projecting portions to receive coating composition flowing from said open-ended channels onto said projecting portions and form a plurality of stripes on said web corresponding in width and location with said projecting portions.

2. Coating apparatus as defined in claim 1 wherein said hopper is comprised of a trough having front, back and side walls and a cover plate, said trough and cover plate being adapted to sealingly engage with said shims.

3. Coating apparatus as defined in claim 1 wherein said second shim contains an elongated slot extending over substantially its entire width for directing coating composition into the open-ended channels of said first slim.

4. Coating apparatus as defined in claim 1 wherein said first shim has a thickness in the range from about 0.002 to about 0.02 inches.

5. Coating apparatus as defined in claim 1 wherein said second shim has projecting portions which project beyond the open ends of said channels by a distance in the range from about 0.002 to about 0.03 inches.

6. Coating apparatus as defined in claim 1 wherein the width of each said projecting portion is about 0.01 inches greater than the width of the associated open-ended channel.

7. Coating apparatus as defined in claim 1 including a rotatable drum for supporting said web at the point where said coating composition is applied thereto.

8. Apparatus for use in the multiple stripe coating of a web with liquid coating composition, said apparatus comprising:
   (1) a hopper having a pair of spaced lips;
   (2) a first shim mounted within said hopper and positioned between said spaced lips, said first shim having a plurality of open-ended channels therein; and
   (3) a second shim mounted within said hopper and positioned between said spaced lips in face-to-face arrangement with said first shim, said second shim having a plurality of projecting portions corresponding in width and location to the desired stripes, said projecting portions aligning with said open-ended channels and extending beyond the open ends thereof.

* * * * *